US005199864A

United States Patent [19]

Stecklein

[11] Patent Number: 5,199,864

[45] Date of Patent: Apr. 6, 1993

[54] SPHERICAL FLUID PUMP OR MOTOR WITH SPHERICAL BALL COMPRISING TWO PARTS

[75] Inventor: Gary L. Stecklein, San Antonio, Tex.

[73] Assignee: Southwest Research Institute, San Antonio, Tex.

[21] Appl. No.: 590,464

[22] Filed: Sep. 28, 1990

[51] Int. Cl.[5] ..... F01C 3/06

[52] U.S. Cl. ..... 418/68; 418/53

[58] Field of Search ..... 418/53, 68

[56] References Cited

U.S. PATENT DOCUMENTS

| | | | |
|---|---|---|---|
| 826,985 | 7/1906 | Appel | 418/68 |
| 1,946,343 | 2/1934 | Wicha | 418/53 |
| 3,549,286 | 12/1970 | Moriarty | 418/68 |
| 4,938,025 | 7/1990 | Larsen | 418/53 |

FOREIGN PATENT DOCUMENTS

| | | | |
|---|---|---|---|
| WO823106 | 9/1982 | PCT Int'l Appl. . | |
| WO907632 | 7/1990 | PCT Int'l Appl. | 418/68 |

*Primary Examiner*—Ricahrd A. Bertsch
*Assistant Examiner*—David L. Cavanaugh
*Attorney, Agent, or Firm*—Charles W. Hanor

[57] ABSTRACT

A fluidic machine operable primarily as a pump or a fluid motor having primary and secondary vaned members hinged together within a spherical pump chamber to define four intake and exhaust spaces of varying volumes. A tracking mechanism which includes an annular raceway forces the secondary member to rotate about an oblique axis as the primary member rotates about a primary axis. Consequently, rotation of an input/output shaft extending from the primary member along the primary axis forces the secondary member to pivotally reciprocate between opposite extremes relative to the primary member, thereby increasing and decreasing the volumes of the spaces to produce a pumping action. The pump chamber is provided with four ports in positions which are coordinated with the tracking mechanism to ensure one port is in fluid communication with each space throughout each pivotal stroke of the secondary member. Reverse flow through the pump chamber conversely forces rotation of the primary member and its extending shaft to provide a fluid motor.

1 Claim, 5 Drawing Sheets

SPHERICAL FLUID PUMP OR MOTOR WITH SPHERICAL BALL COMPRISING TWO PARTS

BACKGROUND OF THE INVENTION

1. Field of the Invention

The present invention relates to fluid pumps and motors utilizing or producing rotary shaft power. More particularly, the present invention relates to fluid pumps and motors having primary and secondary vanes moving relative to one another to pump or be driven by fluid in the spaces between the vanes.

2. Background

The first recognized pump, which basically comprised a series of cups mounted on a conveyer for pumping water to a higher elevation, is thought to have been made by the ancient Egyptians in about 2000 BC. Operated in reverse, with the weight of water in the cups forcing the conveyor to rotate in the opposite direction, the ancient Egyptians possibly also used the same device as the first fluid motor. Since then, innumerable pumps have been developed for the purposes of raising, transferring, compressing and attenuating virtually every known type of fluid. Equally innumerable fluid motors have also been developed, which characteristically utilize the energy of a flowing stream to impart mechanical motion. Despite the long history of technological developments both of pumps and fluid motors, man continues in his manifest pursuit of the perfect fluidic machine for each application.

In the course of progress, numerous devices have been quite successful for converting shaft power to flow and vice versa. One of the most successful types of pumps in many applications is the rotary pump, which basically consists of at least two members which are rotated in a fashion such that the members positively displace fluid from an inlet to the proximity of an exhaust, at which point the fluid is exhausted by reduction of a space defined between the two members. Perhaps the most conventional of rotary pumps is the gear pump which consists of two counter-rotating gears which carry fluid in the spaces between their teeth and force evacuation of those spaces by a meshing of the two gears near the exhaust port. A variation of the gear pump utilizes an internal gear or belt meshed with an external gear in an analogous fashion.

Such devices, however, generally suffer from large size to displacement ratios, sliding surface contact, high complexity, and unjustifiable costs.

Many other problems, obstacles and deficiencies faced by the prior art and/or addressed by the present invention will be obvious to those skilled in that art, especially in light of the further descriptions herein.

SUMMARY OF THE INVENTION

It is a primary object of the present invention to provide a new and improved fluidic machine for converting shaft power to flow of a gas or liquid, and/or converting such flow into shaft power, while overcoming the problems and deficiencies of the prior art.

It is also an object of the present invention to provide a novel fluidic machine which may be operative as either a pump or a fluid motor. Another object of the invention is to provide a fluidic machine which optimally utilizes the principles of conventional rotary machines. Still another object of the invention is to produce a simple, inexpensive pump which is capable of yielding a high displacement ratio relative to the size of the pump.

The present invention is directed to accomplishing such objects and others by providing a fluidic machine which includes at least two vanes, one of which is rotatable about a primary axis coincident with an input/output shaft, and the other of which is pivotable relative to the primary vane. The invention combines that structure in a manner such that the volume of a space between the first and second vanes is related to the angular displacement of the shaft, which is preferably if not necessarily connected to the primary vane. The vanes are mounted within a chamber defined by a housing with at least one port, such that the space between the vanes can be positioned in communication with that port. The machine can thus exhaust and/or draw fluid through the port in response to rotation of the input/output shaft, thereby providing the rudiments of a pump. In reverse operation, the same construction may provide a fluid motor wherein fluid under pressure is either forced into or out of the port to cause related rotation of the input/output shaft.

The invention further may include a housing defining a chamber with multiple ports. In such a case, first and second vaned members mounted within the housing may be situated to pivot relative to one another and define a plurality of spaces between the members, wherein each of such spaces are positionable in communication with at least one of the ports. Such a construction is adaptable such that one or more ports may serve as an inlet and the other one or more ports serve as an outlet, and the spaces (of varying volume) are alternatively positioned in communication with the inlet and then the outlet. A mechanism is included to relate the rotation of the first member with the volume of the spaces. More particularly, such a mechanism may serve to pivotally reciprocate the second member relative to the first member between opposite extremes such that the volumes of the spaces between the members are alternatively increased and decreased to first draw fluid into the chamber through an inlet and exhaust fluid out through an outlet, when the machine is operating as a pump. In reverse, when the machine is operating as a fluid motor, the volumes of the spaces increase and decrease in response to the flow of fluid to produce the shaft output.

Many other objects and features of the present invention are set forth and will be clear from the following more detailed descriptions of certain embodiments, which should be considered in light of the prior art.

BRIEF DESCRIPTION OF THE DRAWINGS

Presently preferred embodiments constructed according to the teachings of the present invention are hereinafter described in more detail. To those of ordinary skill in the art, the invention will become more readily understood from the specifications of those embodiments, particularly when considered in light of the appended claims and with reference to the accompanying drawings, wherein like numerals refer to like elements throughout, and wherein:

FIG. 6E also shows a spherical representation of housing 70 in transparent line;

DETAILED DESCRIPTION OF PREFERRED EMBODIMENTS

Figure 1:
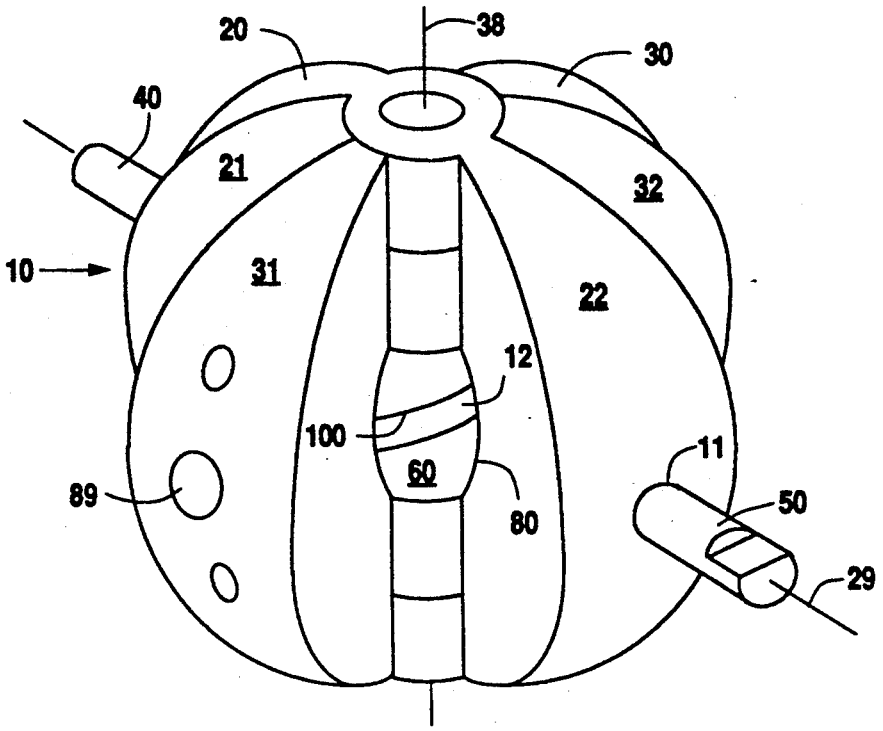
FIG. 1 shows an isometric perspective view of the vane assembly 10 of the first embodiment of the present invention.

Referring to FIG. 1 of the drawings, there is shown an isometric perspective view of the vane assembly 10 of a first embodiment of the present invention. The vane assembly 10 basically comprises a primary member 20, a secondary member 30, input/output shaft 40, stationary shaft 50, and split core 60. As will be discussed further herein, particularly with reference to FIGS. 4 and 5, vane assembly 10 provides a fluidic machine 9 when operatively mounted within a housing 70 having appropriate inlets and outlets. As such, vane assembly 10 may serve as either a pump, for converting shaft power into fluid flow, or as a fluid motor, converting fluid flow into shaft power. Other possible uses of the fluidic machine 9 or vane assembly 10, such as to provide combustion and/or compression chambers in an internal combustion engine, will be understood by those of ordinary skill in the art.

For purposes of this description, however, fluidic machine 9 is first described as a pump, with input/output shaft 40 being referred to as "input shaft" 40. Reference is also made in this description to "upper", "lower" and "horizontal" features when referring to certain drawings. Such references are made only to render the description more easily understood in view of the upper and lower orientations in the drawings and in view of a reference orientation of machine 9 relative to an assumed horizon. As will be evident to those of ordinary skill in the art, such orientations are not necessarily maintained throughout the operation of the described embodiments, much less would they be required for utilization of the invention.

Although not essential to the present invention, the diameter of the vane assembly 10 of the first embodiment is relatively small, approximately three and a half (3½) inches, while the swept volume for each full revolution of vane assembly 10 in an equally sized spherical pump chamber 75 (shown in FIG. 4) is nearly equal to the full volume of pump chamber 75. Greater values of swept volume per revolution may be readily achieved through modification of the first embodiment in line with the teachings of the present invention, such as by variation of the relative sizes, shapes and proportions of primary member 20, secondary member 30 and split core 60. Vane assembly 10, as well as other components of fluidic machine 9, may be cast or machined from a wide variety of materials including many metals and plastics.

The primary member 20 of vane assembly 10 is rotatably mounted to housing 70 about a single axis, primary rotational axis 29. Input shaft 40 and stationary shaft 50 protrude from diametrically opposite sides of primary member 20 and are coincident with primary rotational axis 29; hence, primary member 20 is rotatable relative to housing 70 about input shaft 40 and stationary shaft 50. Secondary member 30, in turn, pivots relative to primary member 20 about a hinge axis 38. Hinge axis 38 (shown in FIGS. 1–3) is perpendicular to primary rotational axis 29 and is fixed relative to primary member 20. Although not shown in FIG. 4, hinge axis 38 is perpendicular to the plane of FIG. 4. In the preferred embodiment, input shaft 40 is rigidly connected to primary member 20, while vane assembly 10 is freely rotated relative to stationary shaft 50.

Figure 2:
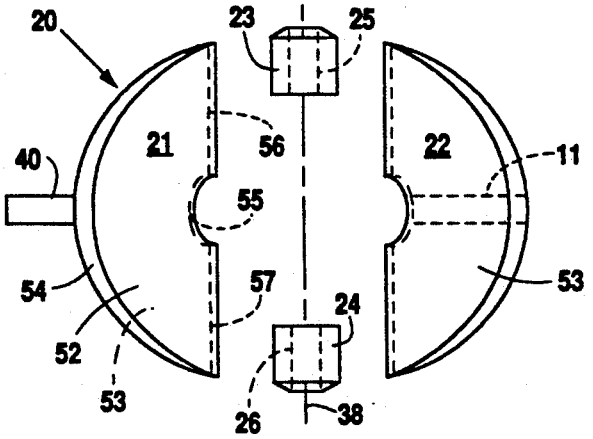
FIG. 2 shows an exploded view of the primary member 20 of the vane assembly 10 shown in FIG. 1.
Figure 3:
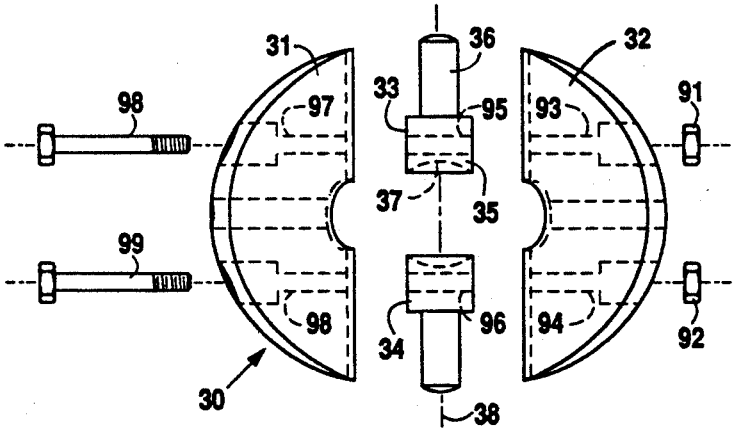
FIG. 3 shows an exploded view of the secondary member 30 of the vane assembly 10 shown in FIG. 1.

Although alternative vane assemblies are envisioned within the scope of the invention, as is evident in FIGS. 1, 2 and 3. The general shapes of both primary member 20 and secondary member 30 in the preferred embodiment are radially symmetrical relative to hinge axis 38. As is evident in FIGS. 1, 2 and 3, referring particularly to FIG. 2, primary member 20 in the preferred form comprises opposing vanes 21 and 22 which are joined at their upper and lower ends by collars 23 and 24 respectively. Collars 23 and 24 are annularly cylindrical in shape, each having a central bore (25, 26) therethrough. When assembled in housing 70, collars 23 and 24 are coaxial with hinge axis 38. The inner surfaces 56 and 57 of each of vanes 21 and 22 are permanently joined by conventional bonding means to opposite side walls of collars 23 and 24, respectively.

Similarly, referring to FIG. 3, secondary member 30 also has opposing vanes 31 and 32 which are connected to opposite side walls of central members 33 and 34. Central members 33 and 34 are identical to one another in shape and are each positioned coaxially with hinge axis 38. Each of central members 33 and 34 basically consists of a cylindrical boss 35 having a coaxial pin 36 projecting therefrom. The boss 35 has the same diameter as collars 23 and 24 while the pin 36 has the same diameter as bore 25, allowing some tolerance to enable the pivotal movement of secondary member 30 relative to primary member 20. The inner surfaces 37 of central members 33 and 34 are concave for enabling rotatable engagement of surfaces 37 with a spherical core 60 which will be described further herein.

Central members 33 and 34 also have through bores 95 and 96, respectively, oriented transversely through the bosses 35 thereof. Parallel bores 97 and 98 and opposite parallel bores 93 and 94 are provided through the sagital planes of vanes 31 and 32, respectively, perpendicular to hinge axis 38. Each of bores 93–98 is of the same inside diameter, except that bores 93, 94, 97 and 98 are provided with counter sinks for enabling rigid connection of vanes 31 and 32 to central members 33 and 34.

Vanes 31 and 32 are integrally joined with central members 33 and 34 by means of two screws 98 and 99 which are inserted through countersunk bores 96 and 97, through bores 94 and 95 and opposite countersunk bores 93 and 94 in vane 32. As is clear from FIG. 3, once inserted through the opposite countersunk bores 93 and 94, screws 98 and 99 are threadably engaged with mating nuts 91 and 92, respectively. Through bores 94 and 96, naturally are aligned with countersunk bores 97, 93 and 97, 94 respectively. Vanes 31 and 32 also have radially oriented bores 89 and 90 (FIG. 4) centrally disposed therethrough for purposes which will be described further herein.

Vanes 21, 22, 31 and 32 have substantially the same shape as one another. Each of vanes 21, 22, 31 and 32 of the preferred embodiment are wedge-shaped sections of a sphere having the diameter of pump chamber 75 (numbered in FIG. 4). Referring to surfaces shown in FIGS. 2 and 3, the shapes of vanes 21, 22, 31 and 32 are defined principally by opposite planar surfaces 52 and 53 and four quadric surfaces 54–57. More particularly, surface 54 is convexly spherical in nature to sealingly match with the spherical interior surface 74 of housing 70, allowing some tolerance for enabling rotation of primary and secondary members 20 and 30 within pump chamber 75; interior surface 55 is concavely spherical in nature and concentric with surface 55 to sealingly match with the exterior surface of spherical core 60 (shown in FIG. 1). The spherical surfaces 54 and 55 engage the interior surface 74 of housing 70 and the exterior surface of central core 60, respectively, in both slidable and sealing relationship to facilitate the efficiency of fluidic machine 9. Both the interior surface 74 of housing 70 and the exterior surface of central core 60 are preferably lubricated to minimize frictional losses. In fact, all surfaces which slidingly mate with other surfaces in the preferred embodiment are preferably lubricated. As will be evident to those of ordinary skill in the art, the equivalent of such lubrication may be achieved by the use of coatings or by proper selection of the composition and finish of the mating surfaces.

Planar surfaces 52 and 53 are oriented perpendicular to spherical surfaces 54 and 55 and, for each of vanes 21, 22, 31, and 32, the dihedral angle between planar surfaces 52 and 53 is preferably as small as practical. In the illustrated embodiment, that dihedral angle is less than 45 degrees for each vane, although the dihedral angles may vary from vane to vane. Surfaces 56 and 57 are concavely cylindrical in nature to match with the exterior surfaces of collars 23 and 24 and the exterior surfaces of the bosses 35 of central members 33 and 34. Notably, when vane assembly 10 is assembled within housing 70, the interior surfaces 55 of each of vanes 21, 22, 31 and 32 and the inner surfaces 37 of central members 33 and 34 describe a spherical socket 80 (numbered in FIG. 1) within which central core 60 is disposed.

Figure 4A:
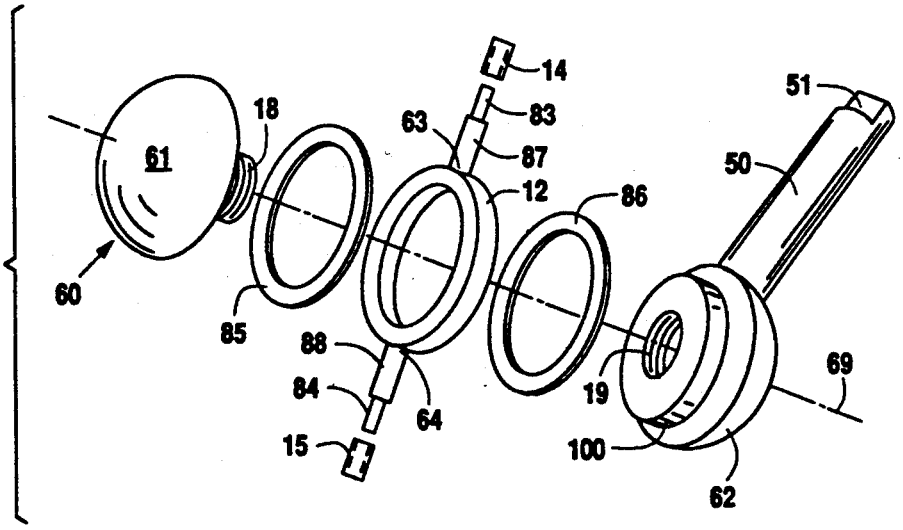
FIG. 4A shows an exploded perspective view of the core 60 of the embodiment shown in FIG. 4, with shafts 50, 87 and 88 extending therefrom.
Figure 4:
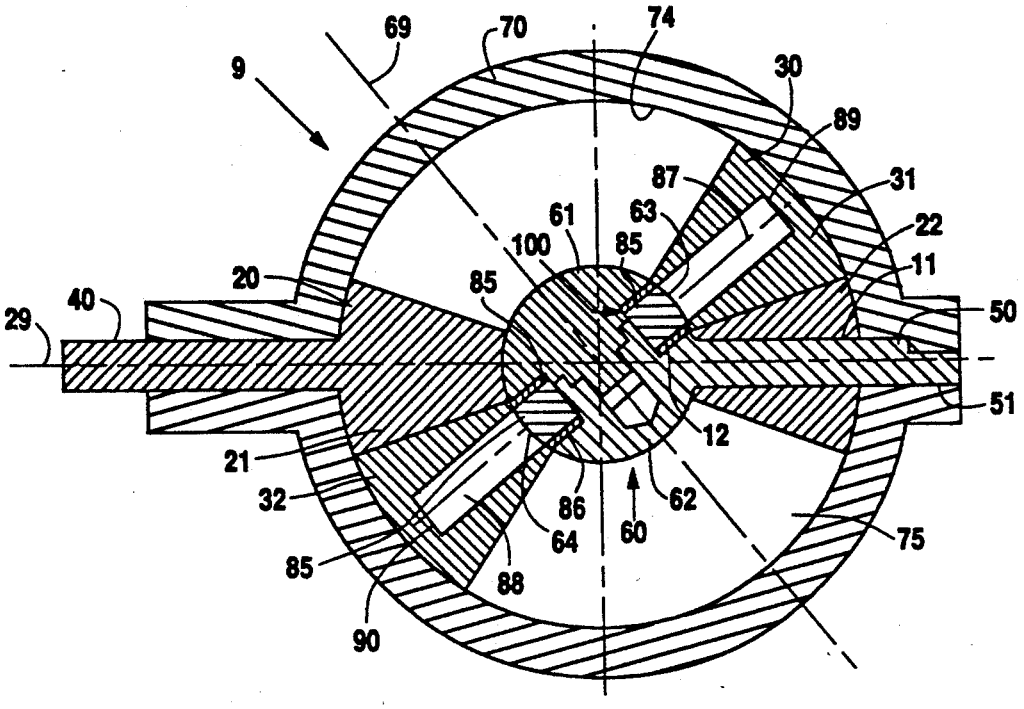
FIG. 4 shows a central cross-sectional view of the first embodiment of the fluidic machine 9 of the present invention with the cross section taken on a vertical plane coincident with shafts 40 and 51, showing the primary member 20 in a horizontal orientation which corresponds with that shown in FIG. 6A.

Referring to FIGS. 4 and 4A, spherical core 60 of the preferred embodiment is shown in more detail. Core 60 actually comprises two roughly hemispherical halves 61 and 62 which are joined together by conventional means in a manner which retains collar 12 with accompanying bearings 85 and 86 in an annular raceway 100. Annular raceway 100, in the preferred embodiment, circumscribes spherical core 60. The annular shape of raceway 100 lies in a plane which is perpendicular to FIG. 4 and which, as is evident, intersects the central axes of spindles 87 and 88. Because central core 60 is fixed relative to housing 70 as will be discussed further herein, both annular raceway 100 and the plane in which it lies also remain stationary, although spindles 87 and 88 rotate within said rotational plane. Spindles 87 and 88 are preferably positioned through the mass centroids of secondary member 30. Axis 69, which is perpendicular to the plane of raceway 100, is referred to as the offset rotational axis 69. Offset rotational axis 69 is similarly fixed relative to housing 70.

Spindles 87 and 88 are modified shafts disposed through central bores 89 and 90 of vanes 31 and 32, respectively. The distal ends 83 and 84 of spindles 87 and 88 may be provided with roller bearings 14 and 15 (shown only in FIG. 4A), respectively. Such roller bearings enable rotation of vanes 31 and 32 relative to said distal ends 83 and 84. Bearings 85 and 86, which are washer-like bearings, enable rotation of collar 12 about offset rotational axis 69. The central ends of spindles 87 and 88 are formed integrally with collar 12 such that spindles 87 and 88 extend radially from diametrically opposite sides of collar 12. The distal ends 83 and 84 are of reduced diameter for enabling reception of roller bearings 14 and 15 thereon.

As will be evident from FIG. 4A, the inner and outer diameters of bearings 85 and 86 and collar 12 are roughly the same. The inner diameter of collar 12 is sized to enable a relatively snug but easily rotatable fit in raceway 100. Although appearing cylindrical, the outer surfaces of collar 12 are slightly convex to contribute to the spherical shape of core 60. The opposed halves 61 and 62 of core 60 define raceway 100 therebetween when half 61 is rigidly connected to half 62. The two halves 61 and 62 are joined in the first embodiment by threading a central shank 18 of half 61 into a threaded bore 19 central to half 62. The dimensions of raceway 100 are sufficient to enable easy rotation of collar 12 therein while still confining collar 12 within a single plane of rotation.

Many other alternative bearing and shaft arrangements will be apparent to those of ordinary skill in the art as equivalents or alternatives to that described above. For instance, one conceived alternative is to simply eliminate collar 12 and, instead, allow the central ends 63, 64 of spindles 87 and 88 to travel in raceway 100 without the aid of collar 12. A variety of bearings could be used to facilitate such an alternative.

The lower half 62 of central core 60 is integrally formed with shaft 50. Shaft 50 extends from central core 60 at an acute "offset" angle relative to the plane in which raceway 100 lies, said offset angle being equal to or slightly greater than the dihedral angle of vanes 21, 22, 31 and 32. Due to the acute measure of said offset angle, primary rotational axis 29 obliquely intersects the plane within which raceway 100 lies. Similarly, offset rotational axis 69 is oblique relative to primary rotational axis 29.

From central core 60, stationery shaft 50 extends through central bore 11 in vane 22 and a corresponding key hole 51 provided in housing 70. Once the fluid machine 9 is assembled, stationery shaft 50 is fixed rigidly to housing 70 within keyhole 51 such that secondary rotational axis 69 is fixed relative to housing 70.

Figure 5:
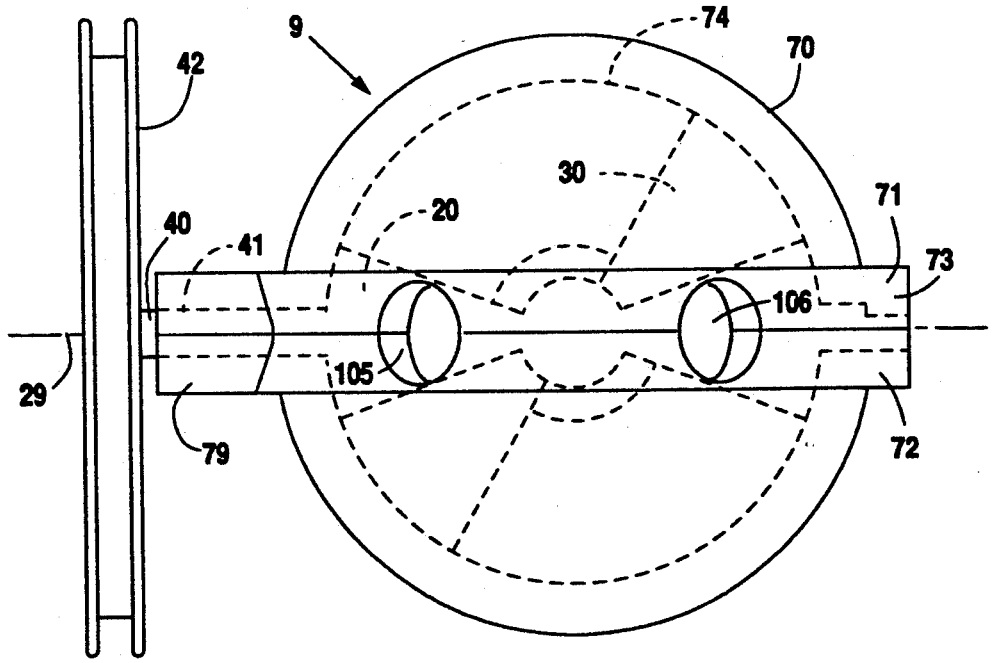
FIG. 5 shows an elevation view of the fluidic machine 9, shown in FIG. 4, in combination with pulley 42.

As shown in FIG. 5, once machine 9 is assembled, input shaft 40 extends through bearing hole 41 and is rigidly secured to pulley 42. Pulley 42 is positioned perpendicular to shaft 40 for rotation about primary rotational axis 29. When fluidic machine 9 is operating as a pump, pulley 42 serves to receive a belt which is drive by an external power source to rotate primary member 20. When fluidic machine 9 is operating as a fluid motor pulley 42 serves as an output mechanism for transferring torque from shaft 40 to a desired external mechanism.

Housing 70 of the first embodiment is substantially spherical in shape except for rim 73. Horizontal rim 73 circumscribes housing 70 and is merely a circumferential radial projection. Housing 70 is actually formed by the joining of two substantially symmetrical halves 71 and 72 which have a roughly hemispherical shape. Extension 79 of rim 73 is provided to facilitate extension of shaft 40 from within pump chamber 75 to the exterior of housing 70 for connection with external devices to facilitate power transmission relative to vane assembly 10.

Figure 6A:
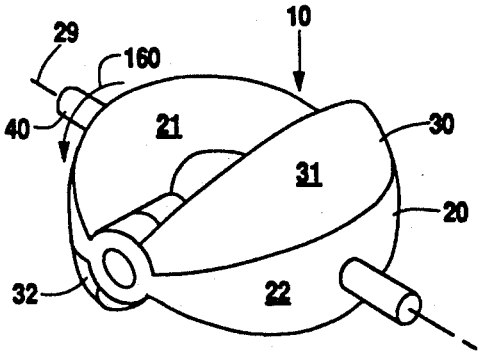
FIG. 6A shows an isometric perspective view of the vane assembly 10 shown in FIG. 1, with the input shaft 40 operatively rotated 90 degrees in reverse from the orientation shown in FIG. 1 such that primary member 20 is substantially horizontal.
Figure 6B:
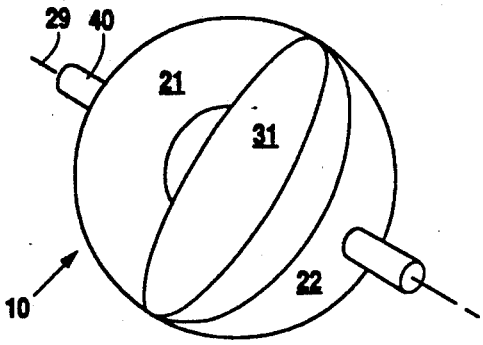
FIGS. 6B–6E show isometric perspective views of the vane assembly 10 shown in FIG. 1 as that vane assembly is operatively rotated from the position shown in FIG. 6A through 45 degrees, 90 degrees, 135 degrees and finally 180 degrees, respectively, about primary axis 29 in the direction of arrow 160 (shown in FIG. 6A)
Figure 6C:
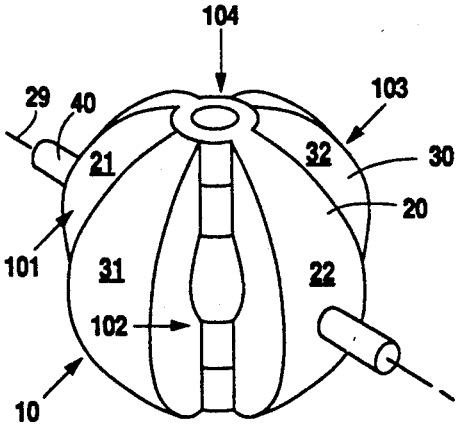
Figure 6D:
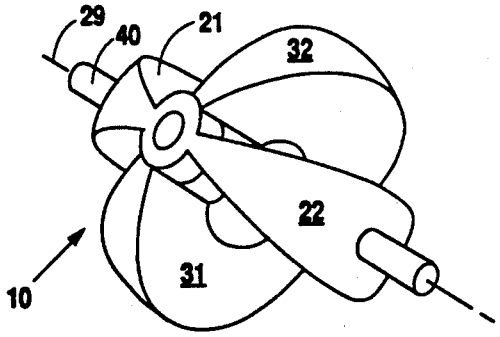
Figure 6E:
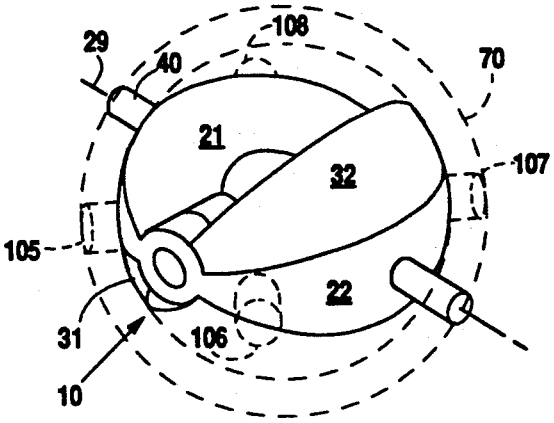

Referring to FIGS. 6A–6E, there is shown a sequential progression of the vane assembly 10 from a horizontal reference position (FIG. 6A) through 45, 90, 135 and 180 degrees of rotation in the direction of arrow 160. Such degrees of rotation refer particularly to rotation of input shaft 40 relative to primary rotational axis 29. In the original position shown in FIG. 6A, primary member 20 is horizontal. During the 180 degrees of rotation illustrated in FIGS. 6B–6E, one can see the concurrent rotation of primary member 20 also through 180 degrees about primary axis 29, which is due to the rigid connection between primary member 20 and input shaft 40. More significantly, though, FIGS. 6B–6E also illustrate the movement of secondary member 30 relative to primary member 20 from a position in which secondary vanes 31 and 32 engage primary vanes 22 and 21, respectively (in FIG. 6A), to a position in which secondary vane 32 engages primary vane 22 and secondary vane 31 engages primary vane 21 (in FIG. 6E). For comparison with the orientations shown in FIGS. 1, 4 and 5, note that FIG. 6C shows an assembly 10 in the same orientation as appears in FIG. 1, and note that FIG. 6A shows vane assembly 10 in the same orientation as it is shown in FIGS. 4 and 5.

Referring particularly to FIG. 6C, which is the same view as FIG. 1, four spaces 101–104 are clearly defined between the respective vanes 21, 31, 22 and 32. Primary member 20 can be considered as subdividing the pump chamber 75 (enclosed by housing 70) into two sub-chambers having the same volume. That volume is further displaced by secondary vanes 31 and 32 such that complementary pairs of spaces are defined in each sub-chambers; specifically, spaces 101 and 102 are complementary, and spaces 103 and 104 are complementary such that the combined volumes of the complementary spaces is constant. It is also clear from a consideration of FIGS. 6A–6E that equivalent but opposite strokes take place concurrently in each of the sub-chambers on opposite sides of primary member 20.

Referring again to FIG. 5, two ports 105 and 106 are shown in housing 70. Housing 70 is symmetrical such that two equally sized ports (107 and 108 shown in transparent line in FIG. 6E) are positioned on the opposite side of housing 70. As is shown best in FIG. 6E, each of ports 105–108 are offset roughly 60 degrees from the primary rotational axis 29 in the horizontal plane, although the exact measure of that offset is not essential to the present invention. As is evident in FIG. 5, the diameter of ports 105 and 106 is of a size such that the planar surfaces 52 and 53 of primary member 20 lie in planes which are tangent to the outer diameter of ports 105 and 106 when primary member 20 is positioned at 0 or 180 degrees rotation (i.e. in the positions shown in FIGS. 6A and 6E).

Hence, transposing the locations of ports 105–108 on each of FIGS. 6A–6E, the occurring sequence of events occurring during the rotation of FIGS. 6A–6E is such that spaces 102 and 104 function as entrance chambers with the action of secondary vanes 31 and 32 drawing fluid in through ports 106 and 108. At the same time, in the same course of events, spaces 101 and 103 serve as exhaust chambers from which any fluid therein is evacuated by the action of secondary vanes 31 and 32 relative to primary vanes 21 and 22, respectively. Thus, fluid is exhausted from spaces 101 and 103 outwardly through ports 105 and 107 during the sequence of FIGS. 6A–6E.

As will be evident to those of ordinary skill in the art, the next 180 degrees of rotation of vane assembly 10 returns vane assembly 10 to its original position shown in FIG. 6A, thereby completing a single revolution of vane assembly 10. During that subsequent 180 degrees of rotation, vane assembly 10 progresses in a fashion similar to that shown in FIGS. 6A–6E, except that the spaces 101 and 103 then function as entrance chambers while spaces 102 and 104 function as exhaust chambers. During a complete 360 degree revolution of vane assembly 10, each of vanes 31 and 32 complete two strokes relative to primary member 20. For instance, vane 31 first travels from a position wherein one of its lateral faces abuts vane 22 to a position wherein the opposite lateral face abuts vane 21 and, during the second stroke, vane 31 travels from abutting vane 21 back to its original position abutting vane 22. Hence, each of vanes 31 and 32 are said to pivotally reciprocate relative to primary member 20 during each revolution of vane assembly 10. It is noteable that, due to the annular but oblique nature of raceway 100, relative to primary rotational axis 29, the velocity of vanes 31 and 32 relative to primary member 20 varies sinusoidally about a mean value which equals the angular velocity of primary member 20. In alternative embodiments (not shown), the path of raceway 100 may be modified (i.e., curved) to achieve variations in the velocity of secondary member 30 relative to primary member 20.

Many other alternatives will also be clear to those of ordinary skill in the art in view of the specification. For instance, the dihedral angle between the opposite planar surfaces of each vane 21, 31, 22 and 32 of the first embodiment may be decreased with corresponding reduction in the offset angle of offset rotational axis 69 such that a greater swept volume can be achieved for the same size housing 70.

Figure 7:
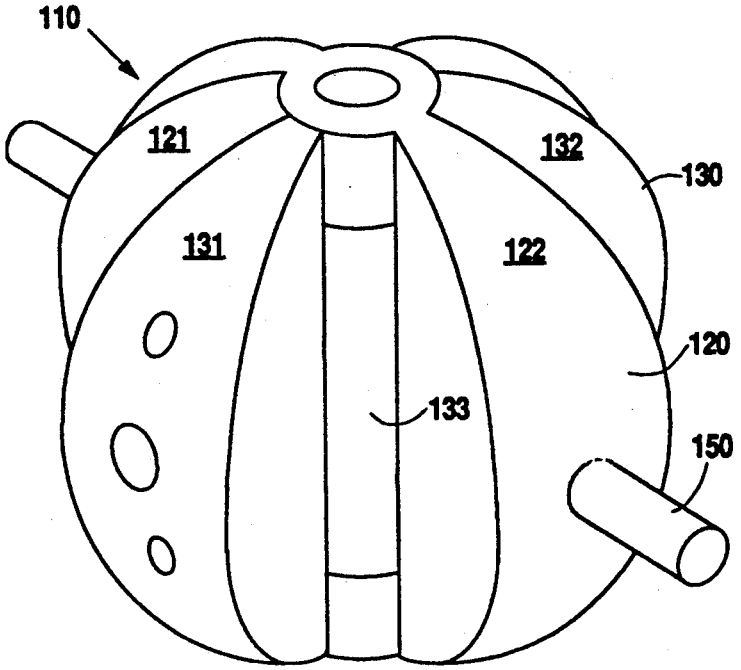
FIG. 7 shows an isometric perspective view of the vane assembly 110 of the second embodiment of the present invention.
Figure 8:
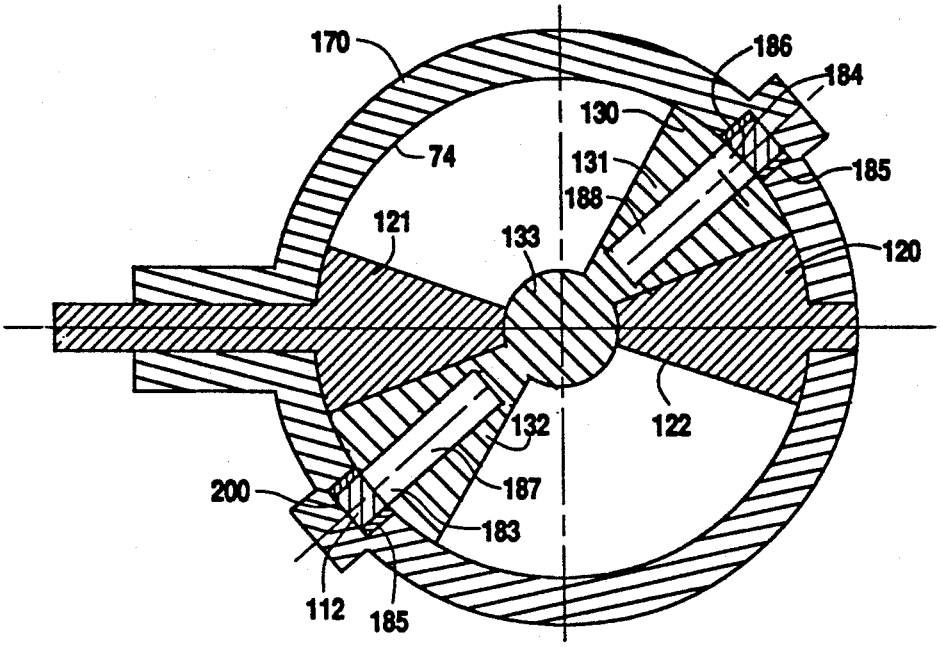
FIG. 8 shows a central cross-sectional view of the second embodiment of the present invention with the cross section taken on a vertical plane coincident with shafts 40 and 51, showing the primary member 20 in a horizontal orientation.
Figure 8A:
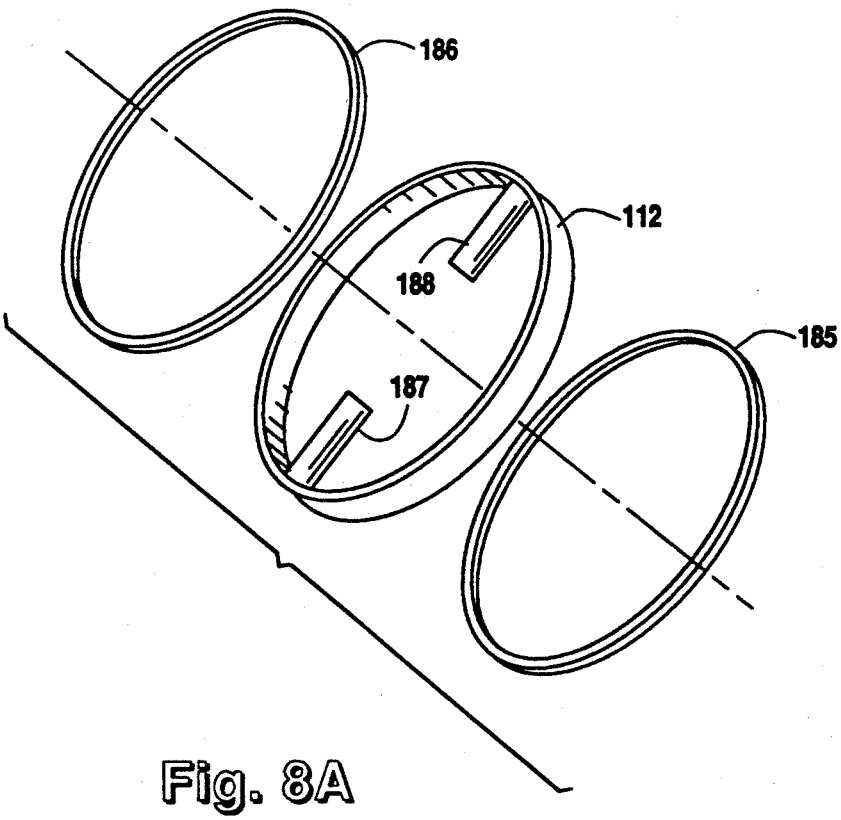
FIG. 8A shows an exploded perspective view of rotating collar 13 and related bearings of the second embodiment shown in FIG. 8.

In one particular alternative embodiment (the "second" embodiment) which is illustrated in FIGS. 7–8A, a larger diameter collar 112 having inwardly protruding spindles 187 and 188 serves as the means for controlling reciprocation of secondary member 130 relative to rotation of primary member 120. The inside diameter of collar 112 matches the inside diameter of the spherical interior surface 74 of housing 170 in order to provide a flush spherical surface. The housing 170 is modified to define an angular raceway 200 between two halves of housing 170 for receiving collar 112 therein. Also received within raceway 112 are washer-like bearings 185 and 186 for enabling rotation of collar 112 within raceway 200. The housing 170 is formed in two halves which are joined by conventional means along raceway 200 for enabling assembly of collar 112 and bearings 185 and 186 within raceway 200. Because spindles 187 and 188 project radially inwardly from diametrically opposite sides of collar 112, spherical core 60 of the first embodiment can be eliminated. Instead, a single central member 133 takes the place of members 33 and 34 of the first embodiment. The cylindrical surface of central member 133 providing the pivotal engaging surface between primary member 120 and secondary member 130, as is evident from a comparison of FIG. 7 with FIG. 1. The stationary nature of shaft 50 is also no longer necessary and, instead, shaft 150 is rigidly connected to vane 122. Spindles 187 and 188 are formed integrally with collar 112 in the second embodiment, although such an integral formation is not essential to the invention.

The other features of the structure and operation of the second embodiment are substantially the same as in the first embodiment except, of course, changes in the interior surfaces of vanes 121, 122, 131 and 132 are preferably modified to accommodate for the absence of core 60. Similarly, the housing 170 of the second embodiment is modified to accommodate for raceway 200 therein, to produce the construction shown in FIG. 8.

As mentioned, the description of the sequence of events reflected in FIGS. 6A–6E assumes that the vane assembly 10 is operating with a positive drive to input shaft 40 such that fluidic machine 9 operates as a pump. In reverse operation, i.e., as a fluid motor, power for rotating vane assembly 10 of the first embodiment or vane assembly 110 of the second embodiment is provided by the appropriate flow of liquids through ports 105–108 (shown in FIG. 6E). For instance, an induced pressure drop between ports 105–106 and/or between ports 107 and 108 would tend to force vane assembly 10 of the first embodiment to rotate in the direction of arrow 160 (shown in FIG. 6A). In order to avoid stalling or the need to assist start up of vane assembly 10 when operating as a motor, the ports 105–108 are preferably slightly larger than shown in FIGS. 5 and 6E. As an alternative to larger ports, additional ports may be located further from primary rotational axis 29. In either of those manners, the effect of blockage of ports 105–108 when primary member 20 is in the horizontal position would be avoided. Fluidic machine 9 could also be combined with appropriately timed poppet valves for use in either a two-stroke or a four-stroke internal combustion engine.

Though described in terms of the foregoing preferred embodiments, such embodiments are merely exemplary of the present invention. In addition, still many other modifications objects, alternatives, variations, substitutions and the like will be obvious to those of ordinary skill in the art. For instance, the number, size and location of the ports 105–108, or the number, size, shape and configuration of the vanes 21, 31, 22 and 32 may be modified while still serving substantially the same purposes of the present invention. Accordingly, nothing herein limits the scope of the present invention, which is defined instead by the claims appended hereto, construed as broadly as possible.

I claim:

1. A fluidic machine comprising:

a housing defining a chamber having a spherical shaped internal wall and at least one inlet port and one outlet port entering said internal wall in spaced relationship; a first vane assembly having a positions with opposed side surfaces of said first vane; chamber space into four parts that vary in volume as said second vane pivotally reciprocates about said second axis; a circular channel formed on said ball element having an axis oblique to said first and second axes; and means operatively connecting said second vane segments to said channel to reciprocate said second vane assembly about said second axis in response to rotation of said first vane assembly about said first axis;

said first vane assembly comprises a pair of segments secured together by two axially spaced sleeves defining said second axis, and a pair of axially spaced pins secured between said segments of said second vane and inserted in said sleeves on said first vane assembly; and said ball element comprises a first generally hemispherical unit concentrically formed about an offset axis defining an acute angle with said axis of said stationary shaft; a second generally hemispherical unit secured to said first unit by threads concentric with said offset axis; said circular channel being defined between said hemispherical units; a ring mounted between said first and second ball units for rotation about said offset axis, and a pair of diametrically opposed radial projections on said ring respectively engagable with radial holes in said second vane segments to permit a free rotation of said second vane segments about said offset axis.

* * * * *